US008563910B2

(12) United States Patent
Elwell, Jr.

(10) Patent No.: US 8,563,910 B2
(45) Date of Patent: Oct. 22, 2013

(54) SYSTEMS AND METHODS FOR TARGETING A PROJECTILE PAYLOAD

(75) Inventor: John M. Elwell, Jr., Sudbury, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 468 days.

(21) Appl. No.: 12/793,090

(22) Filed: Jun. 3, 2010

(65) Prior Publication Data

US 2012/0256038 A1 Oct. 11, 2012

Related U.S. Application Data

(60) Provisional application No. 61/184,602, filed on Jun. 5, 2009.

(51) Int. Cl.

| | |
|---|---|
| ***F42B 10/60*** | (2006.01) |
| ***F42B 15/01*** | (2006.01) |
| ***F41G 7/00*** | (2006.01) |
| *F42B 10/00* | (2006.01) |
| *F42B 15/00* | (2006.01) |

(52) U.S. Cl.

USPC ..... 244/3.21; 244/3.1; 244/3.15; 244/3.2; 89/1.11; 102/473; 102/475; 102/482; 102/501

(58) Field of Classification Search

USPC ..... 102/200, 206, 211–214, 473, 475–480, 102/491–497, 500, 501, 506–510, 374, 102/377–381, 482, 499; 89/1.11; 244/3.1–3.3; 342/61, 62, 67, 68, 175, 342/195

See application file for complete search history.

(56) References Cited

U.S. PATENT DOCUMENTS

| | | | | | |
|---|---|---|---|---|---|
| 3,034,434 | A | | 5/1962 | Swaim et al. | |
| 3,642,233 | A | * | 2/1972 | Bezerie | 244/3.16 |
| 3,807,658 | A | * | 4/1974 | Miller et al. | 244/3.13 |
| 3,844,506 | A | * | 10/1974 | Stavis et al. | 244/3.15 |
| 4,160,415 | A | * | 7/1979 | Cole | 102/214 |
| 4,198,015 | A | * | 4/1980 | Yates et al. | 244/3.15 |
| 4,242,962 | A | * | 1/1981 | Wakeman et al. | 102/213 |
| 4,245,560 | A | * | 1/1981 | Rambauske | 102/213 |
| 4,262,596 | A | * | 4/1981 | Allier et al. | 102/476 |
| 4,277,038 | A | * | 7/1981 | Yates et al. | 244/3.15 |
| 4,383,662 | A | * | 5/1983 | Alongi et al. | 244/3.15 |
| 4,409,900 | A | * | 10/1983 | Currie | 102/213 |
| 4,444,110 | A | * | 4/1984 | Lindner et al. | 102/213 |
| 4,519,315 | A | * | 5/1985 | Arszman | 102/377 |
| 4,566,656 | A | * | 1/1986 | Maudal et al. | 244/3.11 |
| 4,614,317 | A | * | 9/1986 | Stavis | 244/3.19 |
| 4,657,208 | A | * | 4/1987 | Miller et al. | 244/3.22 |
| 4,883,239 | A | * | 11/1989 | Lachmann et al. | 244/3.15 |
| 4,898,341 | A | * | 2/1990 | Terzian | 244/3.16 |
| 4,899,956 | A | | 2/1990 | King et al. | |
| 5,044,156 | A | | 9/1991 | Deffayet | |
| 5,182,418 | A | | 1/1993 | Talley | |

(Continued)

FOREIGN PATENT DOCUMENTS

| | | | |
|---|---|---|---|
| JP | 01296100 | A | 11/1989 |
| JP | 05052499 | A | 3/1993 |

*Primary Examiner* — Bernarr Gregory
(74) *Attorney, Agent, or Firm* — Goodwin Procter LLP

(57) ABSTRACT

A projectile's payload is oriented (independently or by orientation of the projectile itself) toward a target just prior to firing (e.g., detonation of the payload), e.g., for munitions providing an increased kill and casualty area and a fire "in defilade" (left, right, backwards or at any angle) capability.

24 Claims, 6 Drawing Sheets

(56) References Cited

U.S. PATENT DOCUMENTS

| | | | | |
|---|---|---|---|---|
| 5,433,399 | A | 7/1995 | Becker et al. | |
| 5,619,010 | A * | 4/1997 | Holm et al. | 89/1.11 |
| 5,647,558 | A | 7/1997 | Linick | |
| 5,657,948 | A | 8/1997 | Roucoux | |
| 5,782,429 | A * | 7/1998 | Mead | 244/3.11 |
| 5,932,833 | A * | 8/1999 | Hammon et al. | 102/213 |
| 6,216,597 | B1 * | 4/2001 | Bredy | 102/476 |
| 6,276,278 | B1 | 8/2001 | Korpe | |
| 7,059,560 | B2 * | 6/2006 | Ljungberg et al. | 244/3.13 |
| 7,566,027 | B1 | 7/2009 | Johnson et al. | |
| 7,675,011 | B2 * | 3/2010 | Jonson | 244/3.15 |

* cited by examiner

SYSTEMS AND METHODS FOR TARGETING A PROJECTILE PAYLOAD

CROSS-REFERENCE TO RELATED APPLICATION

This application claims priority to and the benefit of, and incorporates herein by reference in its entirety, U.S. Provisional Patent Application No. 61/184,602, which was filed on Jun. 5, 2009.

FIELD OF THE INVENTION

In various embodiments, the present invention relates to military ordnance, such as unguided projectiles, and methods for targeting such ordnance toward difficult-to-reach objectives.

BACKGROUND

In urban or military combat operations, it is often desirable for the warrior to neutralize a target threat (e.g., a group of armed combatants, artillery vehicles, etc.) while maintaining substantial distance therefrom. This can be achieved using guided or unguided projectiles, such as a bomb, grenade, or missile. In using these projectiles, the relative position of the target from the launch location is typically determined with the aid of a ranging device. Then, an operator located at a substantial distance from the target (i.e., at least a few hundred meters) launches a projectile toward the target. The operator may use a hand-held launcher (e.g., hand held grenade launcher such as the M79, M203, or XM320 grenade launchers employed by the military) or a launcher mounted on a platform (e.g., a tripod or a land or air vehicle). The projectile then follows a guided or ballistic trajectory to the target.

Proper launch does not guarantee that the projectile's warhead will be effective against the target. For example, a ballistic projectile may be diverted from its intended path, e.g., due to factors such as tip-off or wind forces. Guided projectiles also require some form of course-correcting capability for operation throughout their flight trajectory, adding to the size, weight, and cost of the weapon. Even for guided weapons, which may be used to mitigate these error-producing factors, the target may be positioned behind an obstruction or barrier, potentially eluding the projectile's warhead fragmentation pattern. In such circumstances it may be difficult to project adequate lethality even using guided projectiles.

Moreover, standard warheads may be designed to be lethal only against point or closely clustered targets. Their nearly spherical high-energy detonation pattern often projects many of its fragments up or down rather than toward the intended target, a limitation that results in inefficient destruction of certain widely dispersed targets (e.g., groups of separated individuals). Thus, the standard projectile's warhead can have a limited kill and casualty radius requiring small miss distances, which are often sensitive to many operator or environmental effects that limit effectiveness.

Often, dispersed targets can be engaged using projectiles with focused warheads. In such systems the lethal fragments are directed to impact only into those areas of interest. An example of a warhead having such characteristics is the Claymore mine, which directs its fragments forward in a fan-like pattern that produces numerous causalities inefficient projection of fragments upward or downward. In effect, this allows a smaller warhead to have the effectiveness of a much larger warhead. To use such a warhead on a moving projectile effectively, however, it must be very accurately oriented at detonation, typically to a degree or less, and that detonation must be very accurately timed.

SUMMARY OF THE INVENTION

In various embodiments, the present invention features a steerable projectile that can carry a focused payload, and systems and methods for orienting the projectile toward a target just prior to firing the payload. The ability to reorient the projectile when in the vicinity of the target permits firing backwards or at any other aspect angle in order to attack targets that are behind barriers. The ability to orient left, right, or at any angle to fire laterally confers flexibility in complex targeting environments (e.g., down an otherwise-obscured side street).

In general, "firing" refers to detonation of the payload, which may be, for example, an anisotropic warhead (although non-explosive payloads are not precluded) or other warhead such as a shaped charge. In one embodiment, the warhead replicates the fragmentation pattern of a Claymore mine upon detonation. More specifically, in one embodiment, the warhead's fragmentation pattern may have a high-aspect rectangular shape (i.e., approximately 2 meters high by 34 meters across, and a density of approximately 7 fragments per square meter) at some distance (i.e., 50 meters) from its detonation. This fragmentation pattern makes the warhead highly efficient and lethal while, at the same time, the warhead pattern is generally required to be oriented parallel to the threat horizon with attitude accuracies of better than a degree.

In accordance with the present invention, this may be achieved by determining the terminal in-flight location of the projectile, and the location of the target relative to the projectile's location just prior to warhead firing. As used herein, the expression "just prior to warhead firing" means at an instant at which the projectile is determined to have reached a certain distance from the ground (or from an elevated target), which distance is selected based on the velocity of the projectile, height of the target, and the dispersal pattern of the payload. At that instant, terminal maneuvers are initiated such that the projectile is oriented toward the target based on the target's relative location to the projectile. As used herein, the expression "oriented toward a target" means orienting the projectile such that a target or target group is within the region of effectiveness (e.g., lethality) of the payload. The term "target" can also include a group of individual targets dispersed within a region. The term "substantially" means±10%, and in some embodiments, ±5%.

While the discussion above contemplates target destruction, it should be understood that projectiles that can be reoriented just prior to payload activation can be used for other purposes. For example, the payload can be a camera in a thrown or launched projectile, and terminal maneuvers can orient the camera to image a threat behind a barrier, for example. Accordingly, the term "fire" generally refers to activation of the payload to perform its intended function.

Accordingly, in one aspect, embodiments of the invention feature a projectile comprising a computation module for computing one or more parameters for orienting the projectile prior to firing toward a target in order to optimize the effectiveness, against the target, of a payload in the projectile. The projectile also includes a mechanism for adjusting, in response to the computed parameter(s), the projectile's orientation following a guided or unguided flight thereof and just prior to firing of the payload.

The computation module can determine the projectile's location and attitude relative to a projectile's initial launch location and the projectile's velocity, distance from ground, yaw and/or pitch orientation and roll rate. The computation module can include an inertial navigation system for determining the projectile's location relative to a projectile launcher. The navigation system can include gyros and accelerometers including accelerometers for measuring a pitch-up angle of the projectile at launch for relative target location determination. The navigation system may also include a magnetometer for measuring the instantaneous roll rate of the projectile. In some embodiments, the computation module includes a proximity sensor for determining the distance of the projectile from the ground and/or the vertical falling velocity of the projectile. Additionally or alternatively, the computation module can determine the location of the target relative to the instantaneous location of projectile. The parameters computed by the computation module can include an activation time for the adjustment mechanism, and the computation module can also be configured to determine the time for firing the payload. Accurate trajectory prediction is a critical component of a successful terminal maneuver in order to enable weapon firing-time calculation in minimum time and with minimum computational resources. A brute-force approach is to utilize a table lookup over all measured parameters to estimate weapon firing time. An alternate approach is to utilize a partial closed-form solution with a reduced-order table. Yet another approach is to use a fast simulation with numerical integration.

The computation module may include processing for comparing the orientation of the projectile with the ground plane and, additionally or alternatively, a means for comparing the orientation angle of the projectile with one or more predetermined final orientation angles. The predetermined final orientation angle can be, for example, zero degrees with respect to the local horizon or 180 degrees with respect to the trajectory axis in the plane of the ground surface, or any other angle to attack targets in defilade. The projectile may take the form of a grenade, an artillery shell, a mortar shell, bomb, missile, rocket, or a small-caliber round. The projectile may further include a booster.

In a second aspect, the invention relates to a method for orienting a projectile having a payload. In some embodiments, the adjustment mechanism includes at least one squib (i.e., a propulsion mechanism typically utilizing a small explosive charge) and at least one triggering mechanism for firing the squib. In various embodiments, at least one parameter for orienting the projectile toward a target is computed, and in response thereto, the projectile's orientation is adjusted following a guided or unguided flight thereof and just prior to firing of the payload.

Computing one or more parameters may include determining one or more elements of the projectile's location relative to a projectile launcher, and/or the projectile's velocity, distance from ground, pitch and yaw orientation, and/or roll rate. Computing the parameter(s) may also include determining the location of the target relative to the projectile. The computed parameter(s) may include a time for adjusting the projectile's orientation. The method can further include determining the firing time for the payload.

These and other objects, along with advantages and features of the embodiments of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1A:
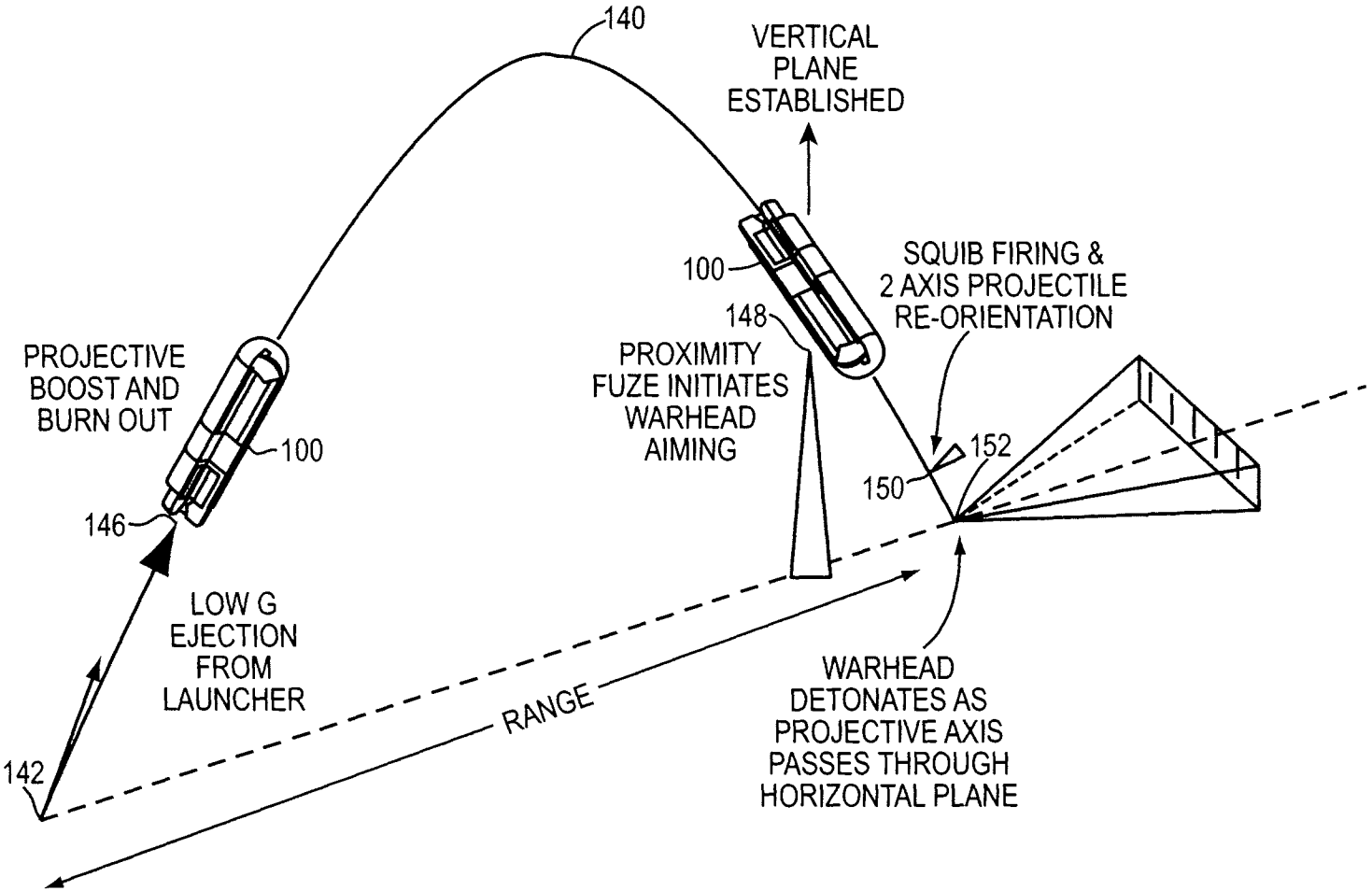
FIG. 1A depicts one embodiment of the projectile flight concept, from aiming, to launch, to flight, to terminal maneuver, to firing.

A notional flight trajectory of one particular embodiment of the invention is depicted in FIG. 1A. The trajectory is exaggerated for convenience in explaining its operational principles. After completion of a fire-control and aiming process, the projectile is launched. Following a lower-g ejection, a booster is ignited at a safe distance from the operator. After launch, the booster, upon ignition, brings the projectile's total velocity up to a level that will allow it to travel the necessary range to the target. The flight trajectory may be monitored by an inertial navigation system as it flies down range to its detonation point. No guidance or control is required to be utilized during the projectile's down-range flight, however, which greatly simplifies implementational requirements (enabling, for example, the employment of existing launchers and sighting systems without modification).

By the time the projectile has reached the end of its trajectory, it has established the local vertical (i.e., gravity) vector to sub-degree accuracy. The navigation system has determined the location of the projectile, just prior to detonation, in the relative reference-coordinate system of the launcher. The target's location, in this same relative coordinate system, has already been determined utilizing the fire-control process prior to launch. These two sets of measurements are sufficient to determine the three-axis orientation angle and timing corrections that are necessary to properly engage the threat grouping with the warhead. These include desired pitch and yaw angles and roll angle timing so as to orient the projectile's warhead focused pattern toward the target.

Relative navigation (i.e., navigation in the projectile's initial launch reference frame) measurement data is sufficient to select the orientation of the focused rectangular-shaped warhead for its terminal aiming maneuver. This terminal maneuver aligns the warhead's pitch and yaw orientation, and roll timing for firing. The terminal maneuver is initiated by the projectile's local ground proximity and closing velocity.

Maneuver corrections are made to the projectile's orientation just prior to warhead firing in order to align the focused fragmentation pattern with the threat grouping. This maneuver can be initiated by activating one or more adjustment mechanisms (e.g., thrust elements such as squibs and/or aerodynamic steering elements such as fins, vanes, or canards) at selected times. For example, separate adjustment mechanisms can each be activated based on one or more of the instantaneous pitch, yaw, and roll angles. These mechanisms are initiated at the precise attitude, time, and height above the ground necessary to produce the required attitude maneuver.

Subsequently, the projectile (and thereby the payload) are re-oriented by causing the projectile to move in one or two attitudes to achieve the correct pitch and yaw angles and roll angle timing. Finally, a firing time (i.e., the time at which the projectile's warhead and fragmentation pattern has become properly oriented toward the target in response to the terminal maneuvers discussed above) can be estimated. Warhead firing is initiated when the focused warhead's preferred roll angle is substantially horizontal, commensurate with the projectile's pitch axis passing through the ground plane. By firing the payload at the correct time, the shaped fragment array or other ordnance will be directed toward the target with the fragmentation pattern oriented so as to increase the likelihood of substantially destroying it.

A projectile using terminal maneuvers can also destroy a target that is in defilade (i.e., concealed behind a fortification or down a side street that might be otherwise unreachable). The warhead can be oriented and detonated around protective obstacles, including, without limitation, detonating from behind the threat, or with left or right offsets. For example, a target group may be positioned behind a barricade. It may not be possible for an operator of the projectile to approach the target or circumvent the barricade. The operator may, nevertheless, launch the projectile, with the projectile flying over the target or otherwise passing it, and during terminal maneuvers re-orienting itself by a sufficient angle (e.g., by 90° to the left or right, or even by) 180° to place the target within the payload's lethal range. Thus, a projectile performing terminal maneuvers can substantially destroy a target despite the absence of a direct path between the operator of the projectile and the target while utilizing standard launchers, sighting systems, and employing a conventional concept of operations.

Figure 1B:
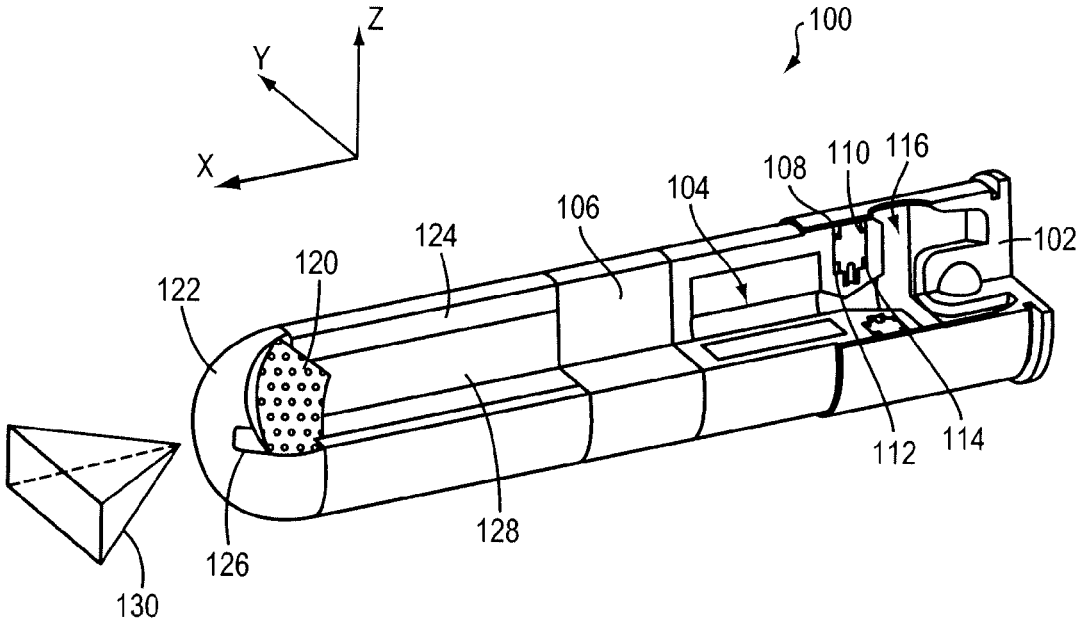
FIG. 1B depicts a partial cutaway view of a projectile in accordance with one embodiment of the invention.

FIG. 1B depicts an exemplary projectile 100 that may be launched from a hand-held or vehicle-based launcher (not shown) such as an M79, M203, or XM320 launcher used by the military, generally in the direction of a target (not shown). In the illustrated embodiment, the projectile 100 is a grenade, but the projectile 100 may instead be an artillery shell, a mortar shell, missile, bomb, rocket, a small-caliber round, or other projectile.

The projectile 100 can be, for example, a military-caliber grenade (e.g., a 40 mm grenade) used by grenade launchers in service with many armed forces. Less powerful (e.g., 40×46 mm) grenades may be used in hand-held weapons such as the M79, M203, and the XM320. More powerful (e.g., 40×53 mm) grenades may be used with launchers mounted on vehicles or tripods, often with automatic firing capabilities.

The projectile 100 includes a launch cartridge 102 that may be ignited at the time of launching. The launch cartridge 102 releases gases upon ignition, propelling the projectile 100 in a desired direction. Depending on the distance to the target, the projectile 100 may contain a booster 104 to extend its range; the booster 104 is ignited at an appropriate point along the projectile's trajectory, providing additional thrust and, therefore, range to the projectile 100. The booster 104, attitude control squibs 108, 110, a push plate 116, and the launch cartridge 102 may be located in a rear section of the projectile 100. The push plate 116 can shield other components within the projectile 100 from the heat generated by firing the booster 104, squibs 108, 110, and/or the launch cartridge 102.

Alternatively, a larger launch cartridge that can provide a stronger initial thrust and, hence, a greater acceleration can also be used. But the stronger initial thrust may have correspondingly larger recoil forces, and if the projectile 100 is shoulder launched or launched from a hand-held launcher, the large recoil force may be harmful to the launcher's operator. Moreover, if the projectile 100 is heavier than a standard grenade, the initial launch velocity of the projectile 100 may be limited in order to achieve a safe recoil force. These factors again favor use of the booster 104. After a lower-g (i.e., low initial velocity) ejection of the projectile 100 from the launcher, the booster 104 is ignited at a safe distance from the soldier.

Prior to launching, a sighting and ranging device (e.g., a laser or similar rangefinder, which is not shown) can provide a pitch-up angle (e.g., 45°) along which the projectile 100 is launched; the projectile 100 follows a ballistic trajectory determined by the pitch-up angle and the projectile's nominal (i.e., expected average) in-flight velocity (e.g., 60 meters/second). The target's distance from the launch location is also typically estimated by the ranging device. After completion of the fire control and aiming process, the projectile 100 is launched. The launched projectile 100 spins or rolls around the axis of travel. A typical initial roll rate at the time of launch can be 40 Hz, i.e., 40 rotations per second. The roll of the projectile 100 provides stability to the projectile 100 during its flight, and helps maintain the desired trajectory. When the booster 104 is ignited, the velocity of the projectile 100 increases. For example, the projectile 100 may have a launch velocity of 50 meters/second; the velocity may increase to 70 meters/second when the booster 104 is ignited, thereby increasing the projectile's range. Correspondingly, the roll rate of the projectile 100 may also increase (e.g., up to 60 Hz), providing stability to the projectile 100 at its increased velocity. Strakes or small pop-out fins may also be used to increase the roll rate and can thus provide for increased flight stability.

In one embodiment, the projectile 100 has a lobbed trajectory that aids in achieving attitude accuracy through measurements of the vertical (i.e., gravity rotation in the projectile frame of reference) vector. This lobbed trajectory also provides a highly observable, dynamic vertical signal that can be measured using relatively low-cost micro-electro-mechanical systems ("MEMS") inertial gyro and accelerometer sensors. The projectile's trajectory may be monitored by an internal inertial navigation system ("INS") as the projectile 100 travels to a detonation point, and no guidance or control is necessary during the projectile's downrange flight. This can simplify the application of the projectile 100 because the existing launchers (such as the M320 launcher) and sighting systems can be employed, without modification, to launch the projectile 100.

With continued reference to FIG. 1B, the exemplary projectile 100 includes a computation module 106 that is equipped with a MEMS INS. Using the INS, the computation module 106 determines the current location of projectile 100 relative to the launch location. For example, the INS can determine the projectile's location in the launcher reference frame to a small error margin (e.g., a few meters). The computation module 106 can also determine the target's location relative to the initial launch location using information previously provided by the ranging device. Using this location data, the computation module 106 determines the target's location relative to the projectile's current location.

Determining and monitoring the target's location relative to the projectile's location allows the computation module 106 to calculate parameters for orienting toward the target a payload 120 contained within the projectile 100. These parameters include the necessary pitch, yaw, and roll angles of the projectile 100 and the firing time for one or more mechanisms (e.g., the squibs 108, 110) that adjust the orientation of the projectile 100. The operation of the computation module 106 is further described below with reference to FIG. 5. It should be noted that the projectile's flight is typically unguided (i.e., ballistic) until just prior to firing of the payload 120. In other words, even though the computation module 106 may determine the target's location relative to the projectile's current location in addition to other parameters, that information typically is not used to adjust or alter the projectile's course during the vast majority of its flight. Rather, as described herein, the projectile 100 and/or payload 120 are re-oriented to face the target just prior to firing of the payload 120.

The squibs 108, 110 can be fired using ignition devices 112, 114. Upon firing, as described below, the squibs 108, 110 change the pitch and/or yaw angles of the projectile 100. Accordingly, the projectile 100 can be oriented toward the target.

In one embodiment, the payload 120 is a warhead contained in a front section of the projectile 100. The warhead 120 includes a fragment array 122 containing shaped fragments 126, a detonator 124 and a high explosive 128. Upon detonation, fragments 126 of the fragment array 122 are dispersed substantially within a fan beam pattern 130. The warhead 120 can, for example, replicate the fragmentation pattern of a Claymore mine upon detonation. More specifically, the warhead's fragmentation pattern may have a high-aspect rectangular shape, e.g., 2 meters high (in a vertical direction, denoted as Z) by 34 meters across (in a lateral direction, denoted as Y) at 50 meters. The warhead's fragmentation pattern may have a density of, for example, approximately 7 fragments per square meter at a distance of 50 meters from detonation in a longitudinal direction, denoted as X. This fragmentation pattern can make the warhead 120 highly lethal in a dispersal region 130, but, at the same time, the pattern must generally be oriented parallel to the threat horizon with attitude accuracies of better than a degree. Of course, the dispersal region 130 is illustrative only and other shapes and sizes (e.g., 2 m×20 m@10 m, 3 m×10 m@15 m, etc.) are within the scope of the present invention. By controlling the pattern of fragments 126 within a confined region 130, the effectiveness of the warhead 120 is increased within that region. The fragments from the exploding warhead 120 can strike a target located within this region 130 with sufficient force so as to substantially destroy the target.

Figure 2A:
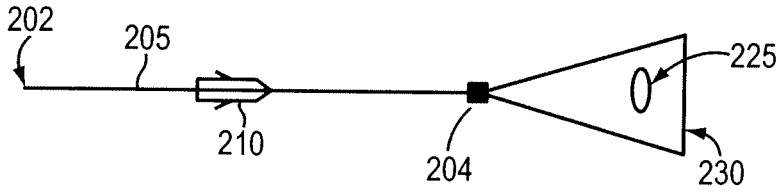
FIGS. 2A-2C depict intended and actual trajectories of a projectile, and the adjustment of a projectile's yaw angle in accordance with one embodiment of the invention so as to orient a payload contained within the projectile toward a target group.
Figure 2B:
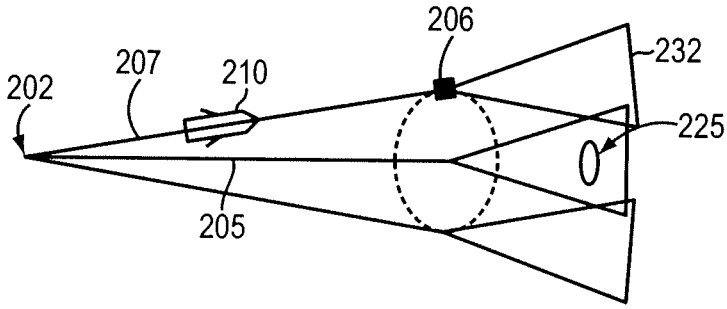
Figure 2C:
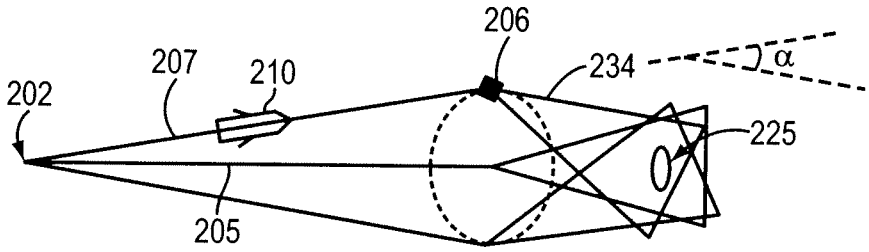

Accordingly, the present invention facilitates orientation of the warhead 120, just prior to its detonation, such that the target is located within the warhead's fragmentation pattern 130. This is schematically illustrated in FIGS. 2A-2C. FIG. 2A shows a launch location 202 of a projectile 210 and an intended detonation location 204 of a warhead contained within the projectile 210. As illustrated, if the projectile 210 travels along the intended ballistic trajectory 205, the warhead will reach the intended detonation location 204. A target group 225 will then be within the lethal region 230 of the warhead at the intended detonation location 204, and may be substantially destroyed by detonating the warhead at the intended detonation location 204.

Due to several possible causes of error, however, the projectile 210 may deviate from the intended trajectory 205. In-flight errors may occur, for example, due to wind and/or drag forces, tip-off (i.e., deflection imparted to the projectile as it emerges from the launcher), and/or misalignment of the booster that may divert the projectile 210 from its desired trajectory. With reference to FIG. 2B, due to one or more errors the projectile 210 travels along an actual trajectory 207, carrying the warhead to a location 206. As previously described, the projectile 210 is generally unguided (although this invention can be applied to guided projectiles) during its flight until detonation of the warhead. Therefore, the projectile 210 typically does not correct its course and resume its intended trajectory 205 once a course error occurs. If the warhead is detonated at the location 206 without being re-oriented, the target group 225 will no longer be located within the dispersion pattern 232 of the warhead. As a result, fragments emitted from the warhead may not destroy, or even reach, the target group 225. In accordance with embodiments of the invention, however, and as illustrated in FIG. 2C, the warhead is oriented toward the target group 225 just prior to its detonation. In general, re-orientation of the warhead is accomplished by re-orienting the projectile 210 carrying it, although in some embodiments, the warhead can be oriented independently of (e.g., within) the projectile 210 using the systems and methods of the present invention.

In certain embodiments, the warhead's dispersal region in the lateral direction is relatively large (e.g., 34 meters at 50 meters), but in the vertical direction it is relatively narrow (e.g., 2 meters at 50 meters). In these cases, and where the projectile 210 is long and narrow (such as in the case of the projectile 100 depicted in FIG. 1B), the warhead can be configured to detonate when the projectile 210 is located substantially the same distance from the ground as the target's height and a lengthwise surface of the projectile 210 is aligned substantially along the ground surface. An exemplary adjustment to the pitch angle of a projectile is illustrated in, and described later with reference to, FIG. 3. With continued reference to FIG. 2C, when the projectile 210 is located at the actual detonation location 206, the desired yaw angle is $\alpha°$. By orienting the projectile 210 substantially at a pitch angle of 0°, a roll angle of 0°, and a yaw angle of $\alpha°$, the target group 225 will be located within the warhead's dispersal region 234. Adjustments for an uneven or sloping ground plane can be made and are discussed later.

Figure 3:
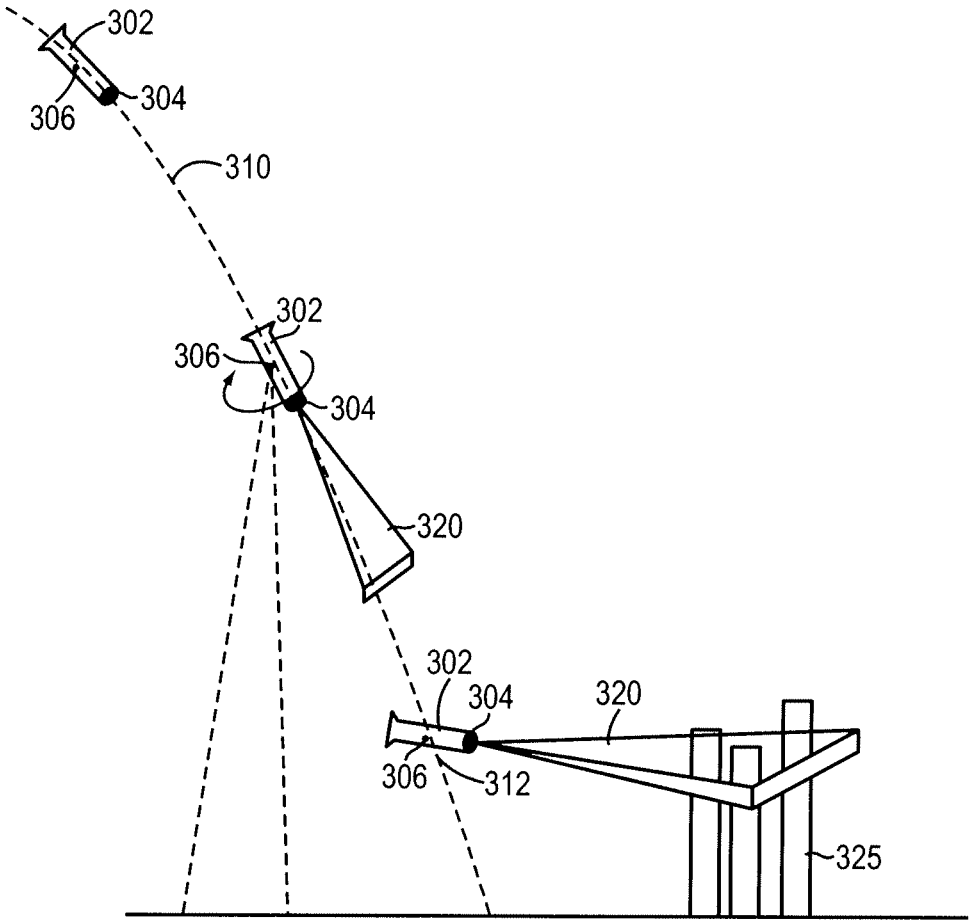
FIG. 3 depicts the adjustment of a projectile's pitch and roll angles in accordance with one embodiment of the invention so as to orient a payload contained within the projectile toward a target group for firing.

In FIG. 3, a projectile 302 descends along a trajectory 310 toward the ground. As the projectile 302 descends, it is rolling or spinning. A warhead 304 carried by the projectile has a dispersal pattern 320. A ground-proximity sensor 306 on the outer surface of the projectile 302 measures the projectile's distance from the ground. When the projectile 302 reaches a pre-determined distance from the ground (e.g., a distance from the ground approximately equal to the height, or the anticipated/estimated height of the target while accounting for ground slope), terminal maneuvers are initiated to re-orient the projectile 302 from a largely vertically sloping attitude to a largely horizontal attitude, as illustrated. During these maneuvers, described below with reference to FIG. 5, the desired pitch and roll angles of the projectile 302 at the time of detonation are determined. FIG. 3 shows that at the location of detonation 312, the projectile 302 is proximate the target group 325, and has attained a pitch angle and roll angle of approximately 0° (for a horizontal plane), such that the target group 325 is within the dispersal region 320 of the projectile 302. If the warhead's dispersal pattern is similar to that of the Claymore mine, the accuracy required in adjusting the yaw angle is generally less critical. The error in determining the required yaw angle can be on the order of several degrees, compared to the sub-degree accuracy required in determining the pitch and roll angles.

Figure 4:
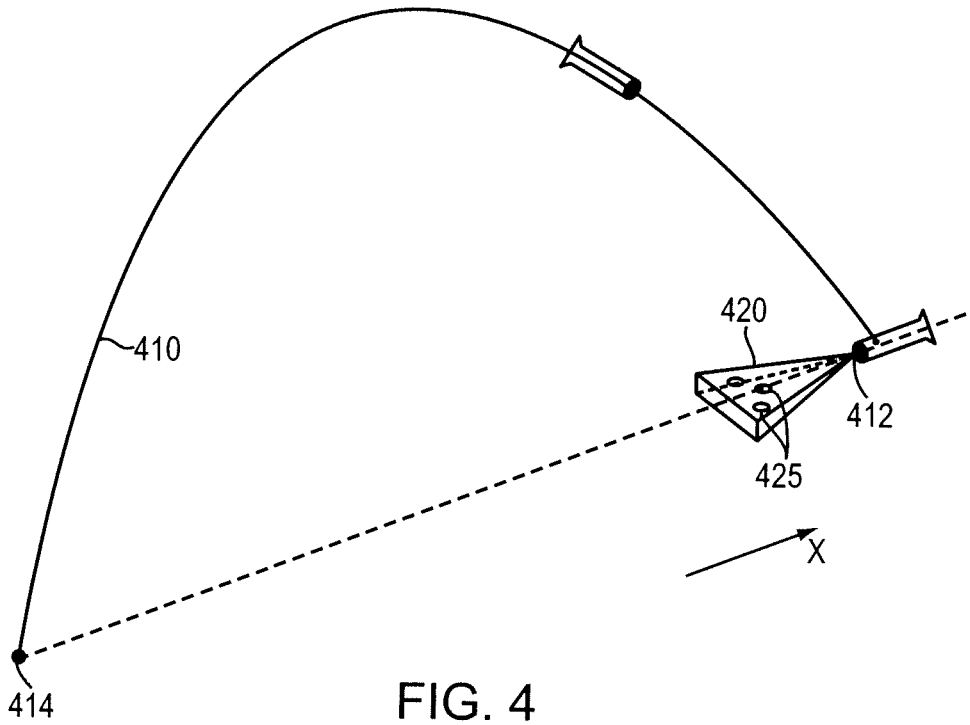
FIG. 4 depicts the orientation of a projectile's payload toward a target that is in defilade in accordance with one embodiment of the invention.

In FIG. 4, a projectile 402 travels along a trajectory 410 to a detonation location 412. In this exemplary figure, the projectile travels over a target group 425 that is in defilade (e.g., behind a barrier). At the detonation location 412, and just prior to the detonation of the warhead, the projectile 402 is turned approximately 180°, thereby orienting the warhead so that the target group 425 is within the dispersal region 420 of the warhead. A similar maneuver can be made to aim at targets that are to the left or right behind barricades.

Figure 5:
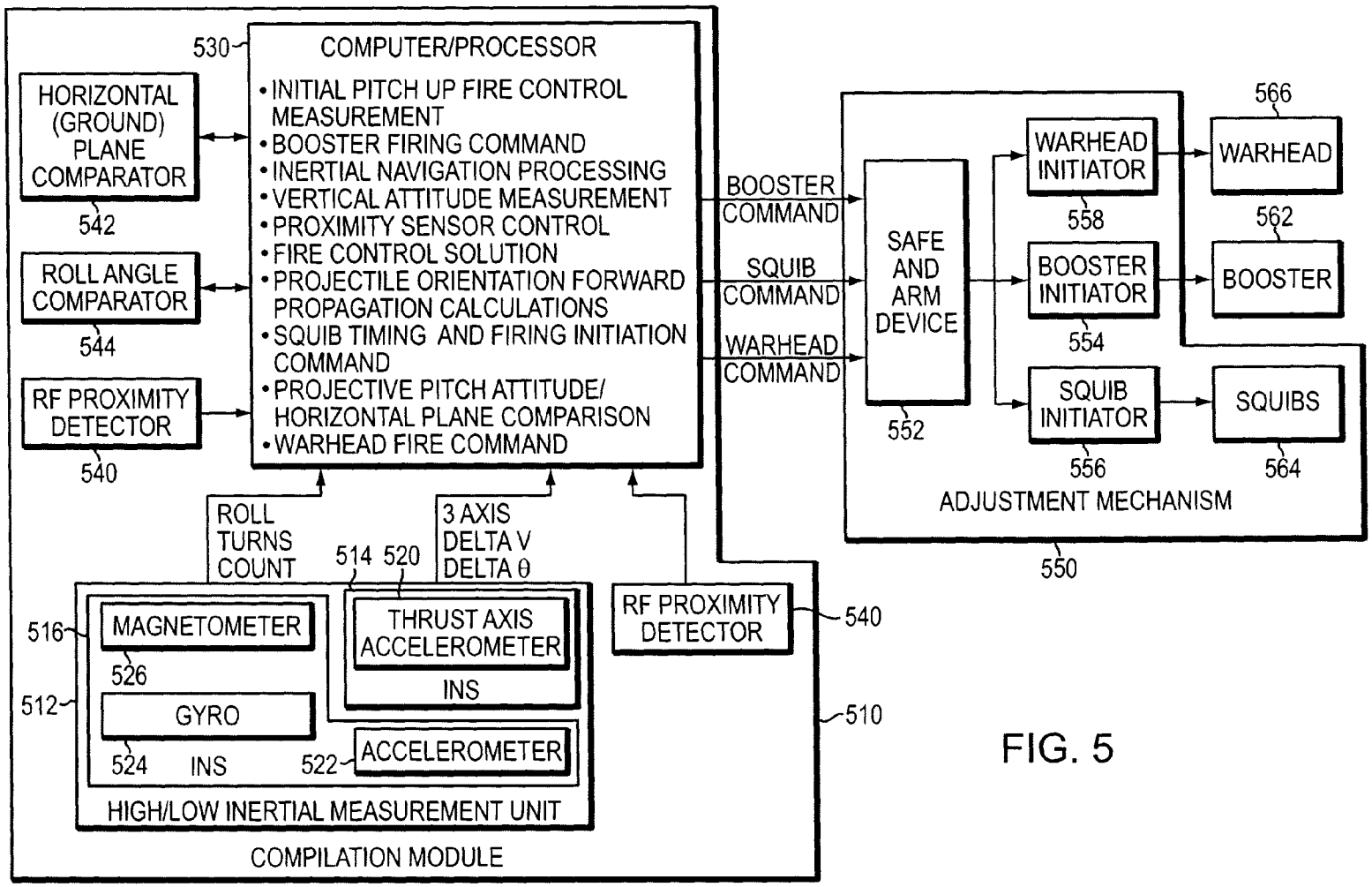
FIG. 5 is a block diagram depicting a computation module and adjustment mechanism for a projectile in accordance with one embodiment of the invention.

FIG. 5 depicts a representative computation module 510 and an adjustment mechanism 550 for a projectile in accordance with one embodiment of the invention. As illustrated, the computation module 510 includes a high/low range inertial measurement unit (IMU) 512 to account for the large dynamic range to be expected between the high launch g's and the lower g's during unguided flight. The IMU 512, in turn, includes two different dynamic range inertial navigation systems (INSs) 514, 516. The first INS 514 may include a high "g" thrust axis accelerometer 520, while the second INS 516 may include a lower "g" accelerometer(s) and gyros 522 and a magnetometer 524. The thrust axis accelerometer 520 can measure very rapid changes in the velocity (i.e., high acceleration) of the projectile. The accelerometer(s) and gyro(s) 522 in the second INS 516 can measure both the projectile's pitch-up angle at the time of launch, and acceleration and pitch and yaw angles during flight. The magnetometer 524 in the second INS 516 provides a vector representing the earth's local magnetic field, from which the projectile's roll rate can be computed to augment the angle rates measured by the gyros.

During an initial period, immediately after the launch, the projectile's velocity may increase rapidly, for example from zero meters/second to 70 meters/second. This initial, high-acceleration period may last be as short as a fraction of a second. In one embodiment, the thrust axis accelerometer 520 in the first INS 514 measures the projectile's acceleration during this high-acceleration period. The pitch and yaw of the projectile do not change substantially during this short time. Meanwhile, the accelerometer 522 in the second INS measures the initial pitch-up angle at the instant of launch. The acceleration and pitch-up angle are measured during the initial period by the accelerometers 520, 522.

Using these measurements, a processor 530 in the computation module 510 determines a booster ignition time based on attainment of a safe distance from the operator, and invokes a booster command at the determined time. The distance of the projectile from the launch location is computed by the computation module 510 as described below. The booster command is processed by a safe and arm device 552, and in one embodiment, the safe and arm device 552 is included in the adjustment mechanism 550. Upon a determination by the safe and arm device 552 that it is safe to ignite the booster 562, the booster command is passed to a booster initiator 554 that ignites the booster 562. As described above, the booster 562 increases the projectile's velocity so that it can carry a warhead 566 to a distant target.

When the initial, high-acceleration period ends, typically a few seconds or a fraction of a second after the booster 562 ignites, the acceleration of the projectile decreases, and it follows a certain trajectory (such as a lobbed trajectory). During this portion of the flight, the second INS 516 receives the initial relative launch location parameters and dynamics measured by the first INS 514. The second INS 516 continues to measure the projectile's acceleration and its attitude angle rates. Using these acceleration and angle rate measurements, the computation module 510 determines the projectile's location relative to the launch location. In particular, the various measurements of acceleration and pitch and yaw angle rates are used to determine the projectile's location in the longitudinal direction (i.e., the direction at which the projectile was aimed at launch) and in a direction lateral to the longitudinal direction and in the vertical based on simple geometry in the relative launch reference frame.

As described above, a warhead's dispersal region can be narrow in the vertical direction (e.g., 2 meters at 50 meters). Therefore, for the warhead 566 to be effective against a target group, it may be desirable to detonate the warhead 566 when it is at approximately the same height from ground as that of the target for a flat ground surface. A typical target group such as a group of armed combatants or a fleet of armed vehicles is only a few meters in height. In such circumstances, the warhead 566 is desirably detonated when it is close to ground, i.e., when it is only a few meters above the ground. Accordingly, it is desirable to accurately measure the projectile's distance from the ground.

In one embodiment, the IMU's determination of the projectile's distance from the ground is corroborated or refined using a distance measurement obtained from a ground-proximity sensor 540. The ground-proximity sensor 540 may be a radio-frequency (RF) sensor, or another proximity sensor such as an optical sensor or an acoustic sensor. The ground-proximity sensor 540 can also be used to determine the slope of the ground (based on successive distance-to-ground measurements as the projectile rotates and travels, which are compared with the expected distances if the ground were flat).

More specifically, the proximity sensor 540 is typically mounted on the outer surface of the projectile. Therefore, as the projectile rolls, the proximity sensor 540 rotates around the projectile's axis of travel. As the projectile descends toward the ground, its rate of descent (i.e., vertical velocity) and roll rate are determined by the computation module 510. Each successive measurement of the distance from the ground by the sensor 540, corresponding to each rotation of the projectile, can be compared against the expected distance from the ground according to the velocity computed by the computation module 510. Using the difference between the distance measured by the sensor 540 and the expected distance, the slope of the ground can be determined.

Determination of the ground slope can be useful in circumstances where the projectile's pitch is adjusted relative to the ground surface. For example, a zero-degree pitch corresponds to orienting the projectile substantially parallel to the ground surface. If the ground on which the target group is located is sloped, the pitch of the projectile relative to a true horizontal plane can be adjusted according to the slope of the ground. The measurement of the ground slope by the proximity sensor 540 enables such an adjustment.

Once the projectile is determined to be at a certain distance from the ground, terminal maneuvers may be executed so as to orient the warhead 566 toward the target. Using the determined locations of the projectile and the target, the target's location relative to that of the projectile can be represented, for example, as a distance in the longitudinal direction (i.e., the direction at which the projectile was launched), a distance in the lateral direction, and a distance in the vertical direction. The computation module 510 uses the target's distance in the lateral direction to determine an appropriate change in yaw angle and the target's distance in the vertical direction to determine an appropriate change in the pitch angle so as to orient the warhead 566 toward the target. Each squib 564 of the projectile, when fired, alters one or both of the projectile's pitch and yaw at a pitch-change rate and yaw-change rate, respectively, that are inherent to the projectile and the power and configuration of its squibs. Accordingly, using these properties, the desired changes in pitch and yaw angles computed by the computation module 510, and the projectile's roll rate, the computation module 510 determines the time of firing each squib 564.

The firing time for each squib 564 may be chosen so that the projectile attains the desired pitch angle, the desired yaw angle, and the desired roll angle at substantially the same time. The computation module 510 can also estimate the time at which this will occur (based once again on the configuration of the projectile and the power and configuration of its squibs) and employ that time as the detonation time of the warhead 566. Additionally, the computation module 510 may include a ground plane comparator 542 for comparing the pitch angle at the detonation time with the ground plane to ensure that a desired pitch angle has been attained. The computation module 510 may also include a roll comparator 544 for ensuring that the desired roll angle has been attained at the detonation time. The computation module 510 may be configured to withhold a command for detonating the warhead 566 until the horizontal plane comparator 542 and roll comparator 544 have ascertained, respectively, that the desired pitch angle and roll angle have been attained.

The safe and arm device 552, booster initiator 554, squib initiator 556, and warhead initiator 558 of the adjustment mechanism 550 are typically charges that are ignited at the appropriate times. At the computed squib firing times, the computation module 510 invokes a squib command that is processed by the safe and arm device 552, as described above. Upon processing, the command activates the squib initiator 556 to select and fire a squib 564. Similarly, at the computed detonation time, the computation module 510 invokes the warhead command that is processed by the safe and arm device 552 to trigger the warhead initiator 558 that detonates the warhead 566. As a result, the dispersal of fragments or other elements from the warhead 566 may be oriented toward, and destroy, the target.

As noted earlier, adjustment mechanisms other than squibs (e.g., aerodynamic steering elements such as fins, vanes, or flaps) may instead (or in addition) be used to controllably alter the pitch, roll and yaw of the projectile during terminal maneuvering of the projectile.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A projectile, comprising:

a computation module for computing at least one parameter for orienting the projectile prior to firing, at a detonation location, toward a target located on a ground to optimize the effectiveness against the target of a focused or anisotropic payload in the projectile; and an adjustment mechanism for adjusting, in response to the at least one computed parameter, the projectile's orientation upon the projectile's arrival via an unguided flight at a point where the projectile is about to detonate, the adjustment mechanism for adjusting the projectile's orientation such that the payload, upon the projectile's detonation, is directed in a direction that is within one degree of the ground's slope.

2. The projectile of claim 1, wherein the computation module determines at least the projectile's location parameters relative to a projectile launcher.

3. The projectile of claim 1, wherein the computation module comprises an inertial navigation system for determining a location and attitude of the projectile relative to a projectile launcher.

4. The projectile of claim 3, wherein the navigation system comprises an accelerometer for measuring a pitch-up angle of the projectile at launch to determine target location.

5. The projectile of claim 3, wherein the navigation system comprises a magnetometer for measuring roll rate of the projectile.

6. The projectile of claim 1, wherein the computation module comprises a proximity sensor for determining at least one of a distance of the projectile from the ground or a velocity of the projectile.

7. The projectile of claim 1, wherein the computation module determines a location of the target relative to the projectile.

8. The projectile of claim 1, wherein the at least one computed parameter comprises an activation time for activating the adjustment mechanism.

9. The projectile of claim 1, wherein the computation module determines a firing time for the payload.

10. The projectile of claim 1, wherein the adjustment mechanism comprises:

at least one squib; and at least one triggering mechanism for firing the at least one squib.

11. The projectile of claim 1, wherein the adjustment mechanism comprises first and second squibs, and first and second triggering mechanisms for activating the first and second squibs.

12. The projectile of claim 1, wherein the computation module comprises a comparator for comparing a pitch of the projectile with the ground's slope.

13. The projectile of claim 1, wherein the computation module comprises a comparator for comparing a roll angle of the projectile with at least one predetermined roll angle.

14. The projectile of claim 13, wherein the at least one predetermined roll angle is zero degrees with respect to a local horizon.

15. The projectile of claim 13, wherein the at least one predetermined roll angle is 180 degrees with respect to a trajectory axis in a plane of a ground surface.

16. The projectile of claim 1, wherein the projectile is selected from the group consisting of a grenade, an artillery shell, a mortar shell, a bomb, a missile, a rocket, and a small-caliber round.

17. The projectile of claim 1, wherein the payload is a warhead.

18. The projectile of claim 1, further comprising a booster.

19. A method for orienting a projectile having a payload, the method comprising:

computing at least one parameter for orienting the projectile prior to firing, at a detonation location, toward a target located on a ground; and adjusting, in response to the at least one computed parameter, the projectile's orientation upon the projectile's arrival via an unguided flight at a point where the projectile is about to detonate, the adjustment of the projectile's orientation causing the payload, upon the projectile's detonation, to be directed in a direction that is within one degree of the ground's slope.

20. The method of claim 19, wherein computing the at least one parameter comprises determining at least one of the projectile's location relative to a projectile launcher, velocity, distance from the ground, roll rate, yaw orientation, or pitch orientation.

21. The method of claim 19, wherein computing the at least one parameter comprises determining a location of the target relative to the projectile.

22. The method of claim 19, wherein the computed parameter comprises a time for adjusting the projectile's orientation.

23. The method of claim 19, further comprising determining a firing time for the payload.

24. The method of claim 19, wherein the target is in defilade or otherwise obscured.

* * * * *